US009628908B2

(12) United States Patent
Niu et al.

(10) Patent No.: US 9,628,908 B2
(45) Date of Patent: Apr. 18, 2017

(54) SOUND COLLECTION METHOD AND ELECTRONIC DEVICE

(71) Applicants: Beijing Lenovo Software Ltd., Haidian District, Bejing (CN); Lenovo (Beijing) Co., Ltd., Haidian District, Beijing (CN)

(72) Inventors: Xule Niu, Beijing (CN); Yanjun Tian, Beijing (CN)

(73) Assignees: BEIJING LENOVO SOFTWARE LTD., Haidian District, Beijing (CN); LENOVO (BEIJING) CO., LTD., Haidian District, Beijing (CN)

( * ) Notice: Subject to any disclaimer, the term of this patent is extended or adjusted under 35 U.S.C. 154(b) by 297 days.

(21) Appl. No.: 14/149,245

(22) Filed: Jan. 7, 2014

(65) Prior Publication Data

US 2014/0192997 A1 Jul. 10, 2014

(30) Foreign Application Priority Data

Jan. 8, 2013 (CN) ..... 2013 1 0005580

(51) Int. Cl.
*H04R 3/00* (2006.01)
*H04R 1/32* (2006.01)

(52) U.S. Cl.
CPC ..... *H04R 3/005* (2013.01); *H04R 1/326* (2013.01); *H04R 2499/11* (2013.01)

(58) Field of Classification Search
CPC ..... H04R 1/326; H04R 2499/11; H04R 3/005
USPC ..... 381/26, 58, 91, 92, 122; 382/103; 386/223, 224; 348/14.01, 79, 207.99
See application file for complete search history.

(56) References Cited

U.S. PATENT DOCUMENTS

| | | | | |
|---|---|---|---|---|
| 6,507,659 | B1 * | 1/2003 | Iredale | H04R 3/005 381/111 |
| 8,090,117 | B2 * | 1/2012 | Cox | H04R 1/406 381/122 |
| 8,705,778 | B2 | 4/2014 | Zhan | |
| 2004/0041902 | A1 * | 3/2004 | Washington | H04N 7/142 348/14.01 |

(Continued)

FOREIGN PATENT DOCUMENTS

CN 101350931 1/2009

OTHER PUBLICATIONS

First Office Action dated Sep. 2, 2016 (18 pages including English translation) out of Chinese priority Application No. 201310005580.9.

*Primary Examiner* — Paul S Kim
(74) *Attorney, Agent, or Firm* — Brinks Gilson & Lione; G. Peter Nichols

(57) ABSTRACT

A sound collection method and an electronic device are disclosed. The method is applicable to an electronic device that includes an image acquisition unit and an audio collection unit. The method includes determining a focus object when the image acquisition unit is acquiring images; obtaining a position relationship information between the focus object and the image acquisition unit based on the focus object; obtaining a first direction information based on the position relationship information; and controlling the audio collection unit to collect the sound from a sound source corresponding to the first direction based on the first direction information.

13 Claims, 3 Drawing Sheets

(56) References Cited

U.S. PATENT DOCUMENTS

| | | | | |
|---|---|---|---|---|
| 2007/0016426 | A1* | 1/2007 | Hershey | G10L 15/26 704/277 |
| 2008/0247567 | A1* | 10/2008 | Kjolerbakken | H04N 7/142 381/92 |
| 2009/0141908 | A1* | 6/2009 | Jeong | G01S 5/20 381/92 |
| 2011/0164141 | A1* | 7/2011 | Tico | G06T 7/2033 348/207.99 |
| 2013/0272548 | A1* | 10/2013 | Visser | G06K 9/00624 381/122 |
| 2013/0315404 | A1* | 11/2013 | Goldfeder | H04R 3/005 381/58 |
| 2014/0071221 | A1* | 3/2014 | Dave | H04M 1/03 348/14.02 |

* cited by examiner

SOUND COLLECTION METHOD AND ELECTRONIC DEVICE

This application claims priority to Chinese patent application No. 201310005580.9 filed on Jan. 8, 2013, the entire contents of which are incorporated herein by reference.

BACKGROUND

In recent years, with the development of electronic technology, more and more different types of electronic devices have come into people's lives, and greatly enriched people's lives. Electronic devices, for example, can be mobile phones, PADs, laptops and etc. Furthermore, electronic devices can include various electronic elements, such as cameras. These electronic devices have different functions, and can be widely used in various fields, such as science and technology, education, health care, construction and etc.

Taking mobile phone as an example, while using the mobile phone, user can use the mobile phone to perform communication, video recording, Internet surfing or other operations.

As for video recording with the mobile phone, the inventor, while implementing the application, found that a microphone of the mobile phone collects all sounds from surroundings during video recording. For example, when the mobile phone is used to record video during a banquet, several users from a certain direction will be record while the microphone of the mobile phone not only collects sound of these users, but also collects sound of other users who are not captured. Therefore, in prior art, when sound are collected with the microphone, a sound source from other directions cannot be shielded, which further results in a case of sound collection and sound source not matching.

SUMMARY

The invention discloses a sound collection method and an electronic device, so as to solve the technical problem that sound collection does not correspond to sound source in prior art.

In one aspect, the invention provides following solutions by one embodiment of the application:

a sound acquisition method, the method being applicable to electronic device, the electronic device includes an image acquisition unit, the electronic device further includes an audio collection unit, the method includes: determining a focus object when the image acquisition unit are acquiring images; obtaining a position relationship information between the focus object and the image acquisition unit based on the focus object; obtaining a first direction information based on the position relationship information; controlling the audio collection unit to collect the sound from a sound source corresponding to the first direction based on the first direction information.

Preferably, the audio collection unit is a collecting unit which includes a microphone array with M microphones, and M is an integer greater than or equal to 2.

Preferably, when the sound source corresponding to the first direction is the only sound source, controlling the audio collection unit to collect the sound from the sound source corresponding to the first direction includes: controlling the microphone array with M microphones to collect the sound from the only sound source.

Preferably, when there are N sound sources corresponding to the first direction and N is an integer greater than or equal to 2, the determining the focus object when the image acquisition units are acquiring images includes: determining a first sound source from the N sound sources as the focus object when the image acquisition unit are acquiring images.

Preferably, the controlling the audio collection unit to collect the sound from the sound source corresponding to the first direction includes: controlling the microphone array with M microphones to collect the sound from the N sound sources, so as to obtain N pieces of sound information; processing the N pieces of sound information based on the focus object, so as to obtain the first sound information corresponding to the focus object; eliminating the sound information in the N pieces of sound information other than the first sound information based on the first sound information.

Preferably, the processing the N pieces of sound information based on the focus object so as to obtain the first sound information corresponding to the focus object includes: Synthesizing M pieces of sub-sound information contained in each of the N pieces of sound information, so as to obtain N sound results corresponding to the N pieces of sound information; matching a first parameter contained in the N sound results with a second parameter corresponding to the focus object, so as to obtain the first sound information corresponding to the focus object.

Preferably, when there are N sound sources corresponding to the first direction and N is an integer greater than or equal to 2, the determining the focus object when the image acquisition unit are acquiring images includes: determining P sound sources from N sound sources as the focus objects when the image acquisition unit are acquiring images, wherein $2 \leq P \leq N$. Preferably, the controlling the audio collection unit to collect the sound from the sound source corresponding to the first direction includes: controlling the microphone array with M microphones to collect sound from P sound sources, so as to obtain P pieces of sound information.

In another aspect, the invention provides following solutions by another embodiment of the application:

an electronic device, the electronic device includes an image acquisition unit, the electronic device further includes an audio collection unit, the electronic device includes: the image acquisition unit, for determining a focus object when the image acquisition unit are acquiring images; a first obtaining unit, for obtaining a position relationship information between the focus object and the image acquisition unit based on the focus object; a second obtaining unit, for obtaining a first direction information based on the position relationship information; a control unit, for controlling the audio collection unit to collect the sound from a sound source corresponding to the first direction based on the first direction information.

Preferably, the audio collection unit is a collecting unit which includes a microphone array with M microphones, and M is an integer greater than or equal to 2.

Preferably, when there are N sound sources corresponding to the first direction and the N is an integer greater than or equal to 2, the image acquisition unit determines, when the image acquisition unit are acquiring images, a first sound source from the N sound sources as the focus object.

Preferably, the control unit includes: an collecting unit, for controlling the microphone array with M microphones to collect the sound from the N sound sources, so as to obtain N pieces of sound information; a processing unit, for processing the N pieces of sound information based on the focus object, so as to obtain the first sound information corresponding to the focus object; an eliminating unit, for eliminating the sound information in the N pieces of sound information other than the first sound information, based on the first sound information.

Preferably, the processing unit includes: a calculating unit, for synthesizing M pieces of sub-sound information contained in each of the N pieces of sound information, so as to obtain N sound results corresponding to the N pieces of sound information; a matching unit, for matching a first parameter contained in the N sound results with a second parameter corresponding to the focus object, so as to obtain the first sound information corresponding to the focus object.

Preferably, when there are N sound sources corresponding to the first direction and the N is an integer greater than or equal to 2, the image acquisition unit is specifically used to, when the image acquisition unit are acquiring images, determine P sound sources from the N sound sources as the focus objects, wherein $2 \leq P \leq N$.

Preferably, the control unit is specifically used to control the microphone array with M microphones to collect sound from P sound sources, so as to obtain P pieces of sound information.

One or more solutions described above have the following technical effects or advantages:

In the one or more solutions described above, a focus object is determined when the image acquisition unit is acquiring images; then a position relationship information between the focus object and the image acquisition unit is obtained based on the focus object; and a first direction information is obtained based on the position relationship information; at last, the audio collection unit is controlled to collect the sound from a sound source corresponding to the first direction based on the first direction information. Furthermore, when the image acquisition unit is acquiring the focus object, it is possible to collect the sound information corresponding to the focus object as appropriate and only the sound information corresponding to the focus object is collected, so that the technical problem of sound collection not matching the sound source from which the sound comes can be avoided, so as to make the collected sound correspond to the sound source from which the sound comes.

Furthermore, the focus object can be one or more subjects, and the processing method for one subject and the processing method for more subjects are different. When there is only one focus object, the audio collection unit only collects sound from the sound source corresponding to the first direction and eliminates sound from other sound sources. However, when there are more than one subject, the audio collection unit collects sound from multiple sound sources.

DETAILED DESCRIPTION

Figure 1:
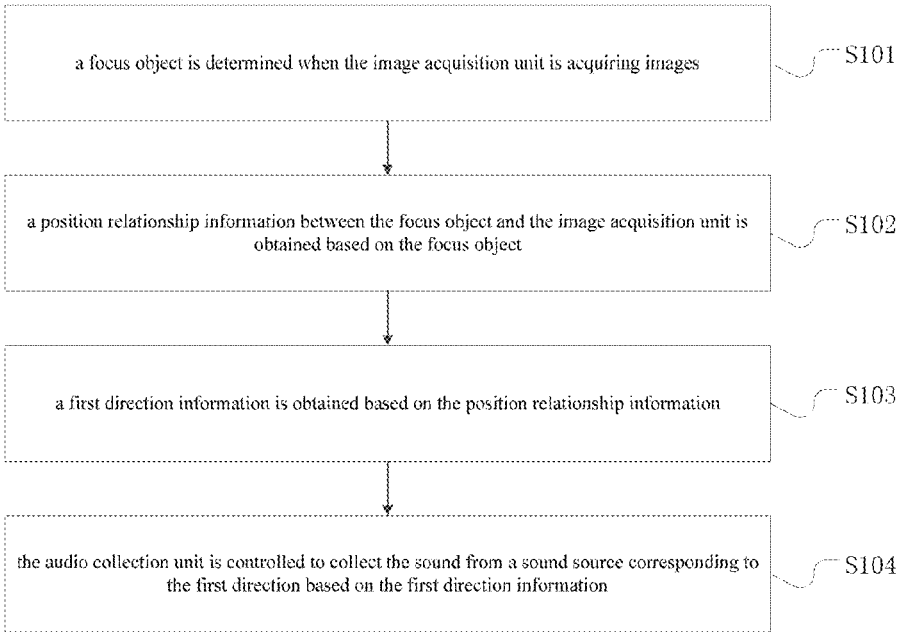
FIG. 1 is a flow chart of a sound collection method according to an embodiment of the application.

In order to solve the problem of sound collection not matching the sound source, embodiments of the invention suggest a sound collection method and an electronic device, the general principle of solutions of which is:

First, a focus object is determined when the image acquisition unit is acquiring images; then a position relationship information between the focus object and the image acquisition unit is obtained based on the focus object; and a first direction information is obtained based on the position relationship information; at last, the audio collection unit is controlled to collect the sound from a sound source corresponding to the first direction based on the first direction information. Thereby, when the image acquisition unit is acquiring the focus object, it is possible to collect the sound information corresponding to the focus object as appropriate and only the sound information corresponding to the focus object is collected, so that the technical problem of sound collection not matching sound source can be avoided, so as to make the sound collection can correspond to sound source.

The solutions of the invention will be explained in details with reference to the figures and embodiments. It should be appreciated that embodiments of the invention and specific features of the embodiments are specific illustrations on solutions of the invention rather than limitations on the solutions. In a case of without any conflict, the embodiments of the invention and technical features of the embodiments can be combined with each other.

Embodiment I

In the embodiment of the application, a sound acquisition method is described.

First, the method is applied to an electronic device.

In practical application, the electronic device has many forms, such as PADs, laptop computers, desktop computers, AllInOne PCs, mobile phones, cameras, and etc. The method of the embodiments can be applied to enumerated various computers.

Furthermore, the electronic device includes an image acquisition unit. However, in practical application, the image acquisition unit is actually a photographing device, which is capable of recording ongoing events, such as a wedding ceremony, or a meeting being held in an office. All these events can be actually filmed to record actual situations when the wedding ceremony or the meeting is being held.

Furthermore, in addition to being capable of recording ongoing events with the image acquisition unit, the electronic device further includes an audio collection unit, which is capable of collecting sound of the scene being recorded in real-time.

More specifically, the audio collection unit is a collection unit including a microphone array with M microphones, M being greater than or equal to 2.

A mobile phone will be taken as an example to illustrate the audio collection unit.

In the mobile phone, one microphone is usually set at the bottom of the mobile phone to collect all sounds generated in the external environment of the mobile phone. However, in the embodiments of the application, it is possible to set one or more microphones at various positions of the mobile phone, such as the back or the side. All sounds generated in the external environment of the mobile phone are collected by these microphones. However, during the collection, when it has to collect sounds from a certain direction, all of the microphone arrays will be adjusted to toward the direction, to shield noises from other directions in order to only collect the sound from the direction.

Hereafter, with reference to FIG. 1, the specific implementation process of the sound collection method according to the embodiments of the invention is:

S101, a focus object is determined when the image acquisition unit is acquiring images.

S102, position relationship information between the focus object and the image acquisition unit is obtained based on the focus object.

S103, first direction information is obtained based on the position relationship information.

S104, the audio collection unit is controlled to collect the sound from a sound source corresponding to the first direction based on the first direction information.

First, in S101, when the image acquisition unit is acquiring images, it focuses on the scene being recorded. For example, a certain subject is focused on to acquire a certain area. In this case, the certain subject or the certain area is the focus object.

In the embodiments of the application, it can be considered that a subject is focused on, such as a certain user in the photographing area.

And while focusing, it can focus manually or automatically.

If it is auto-focus, when the image acquisition unit is acquiring images, the electronic device can calculate the focus object for the image acquisition unit automatically.

If it is manual-focus, when the image acquisition unit is acquiring images, the user taps on the image to choose a certain subject or a certain area in the image, as the focus object.

Then, when the focus object is determined, electronic device can execute S102: position relationship information between the focus object and the image acquisition unit is obtained based on the focus object.

When the focus object has been determined, between the focus object and the image acquisition unit there is a position relationship. For example, if the focus object is a user, the user being at the right side of the image acquisition until is the position relationship.

Furthermore, after the position relationship has been obtained, S103 will be executed: first direction information is obtained based on the position relationship.

Figure 2:
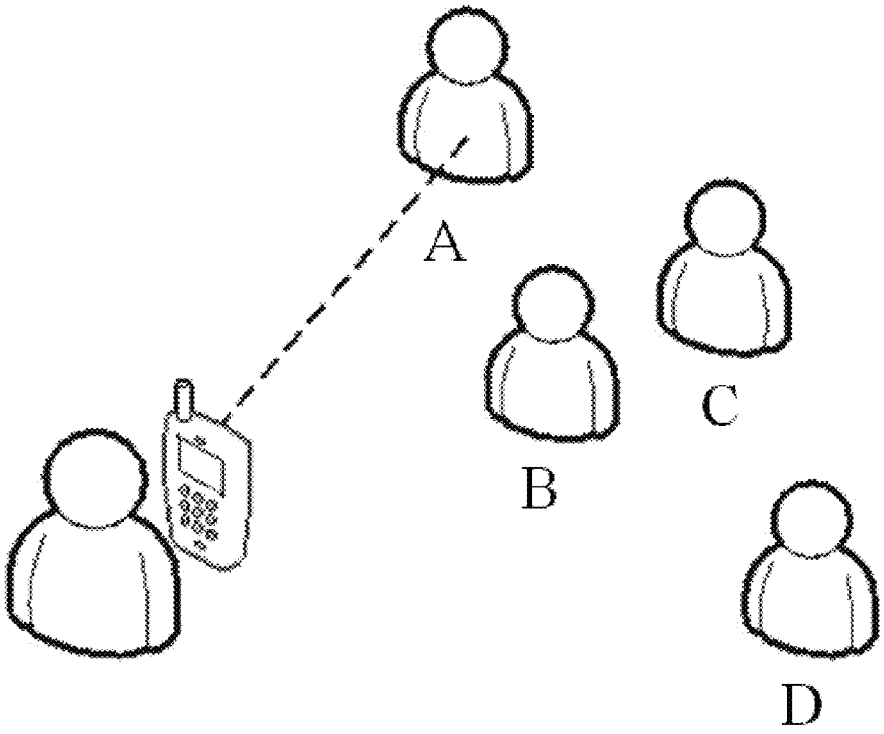
FIG. 2 is an illustrative diagram showing a relationship between a focus object and an image acquisition unit according to the embodiment of the application.

In S103, the first direction information is formed by the focus object and the image acquisition unit, as shown in FIG. 2, there are 4 persons, which are A, B, C, and D.

When another user is recording these four persons with the mobile phone, the position relationship between these 4 persons is: the subject A being recorded is at the right side of the mobile phone, the subject B and C being recorded are in front of the mobile phone, and D is at the left side of the mobile phone.

When photographing, the mobile phone determines one focus object. If the subject A being recorded is the focus object, a direction is formed between the A and the mobile phone, which is the first direction.

Furthermore, based on the first direction, the mobile phone obtains the first direction information, which contains parameters such as the specific location of the first direction, the actual distance between subject A being recorded and the mobile phone and etc., based on the first direction.

When the first direction has been obtained, S104 will be executed: based on the first direction information, the audio collection unit is controlled to collect the sound from the sound source corresponding to the first direction.

Specifically, when the first direction information has been obtained, the audio collection unit will collect the sound from the sound source corresponding to the first direction.

The above process is the specific implementation procedure of sound collection. More specifically, when the audio collection unit is controlled to collect sound, there are many implementations. Hereafter, specific description is given of various cases.

Implementation I:

The sound source corresponding to the first direction is the only sound source.

As shown in FIG. 2, the only sound source corresponding to the first direction is specified as subject A being recorded. In this case, when the first direction information has been obtained, the specific process of sound collection in S104 is: the microphone array with M microphones is controlled to collect sound from the only sound source, i.e., the sound of subject A being recorded.

While collecting sound of subject A, all the microphone array in the electronic device will be turned to toward the direction of subject A.

Implementation II:

The sound sources corresponding to the first direction are N sound sources, and N is greater than or equal to 2.

Figure 3:
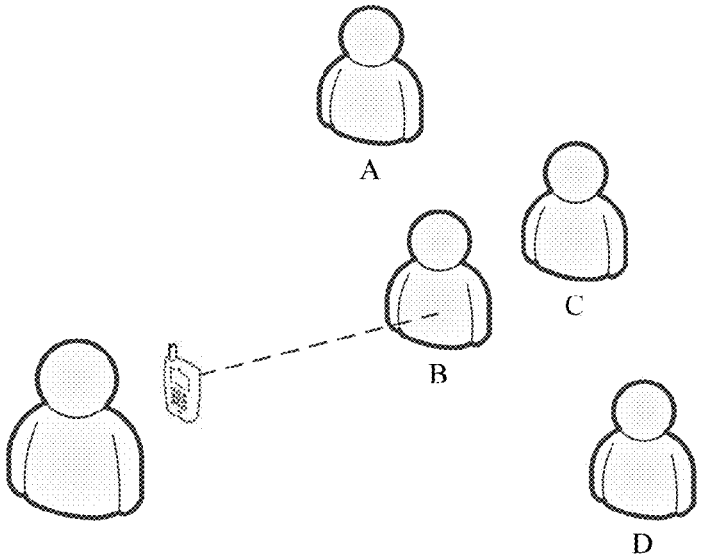
FIG. 3 is an illustrative diagram showing another relationship between the focus object and the image acquisition unit according to the embodiment of the application.

As shown in FIG. 3, if the first direction specifically is the direction formed by the position where B and C locate and the image acquisition unit in the mobile phone, there are two sound sources, which are B and C, in the first direction. In this case, the first direction is a blurred direction, which actually is an area of the direction. In that area, there are two sound sources, which are B and C.

In this case, when the image acquisition unit is acquiring images, determining the focus object specifically is: determining the first sound source among N sound sources as the focus object.

Specifically, either of B and C is determined to be the focus object. For example, subject B is determined as the focus object.

When subject B has been determined as the focus object, the position relationship and the accurate first direction will be determined sequentially in the order of above steps.

Figure 4:
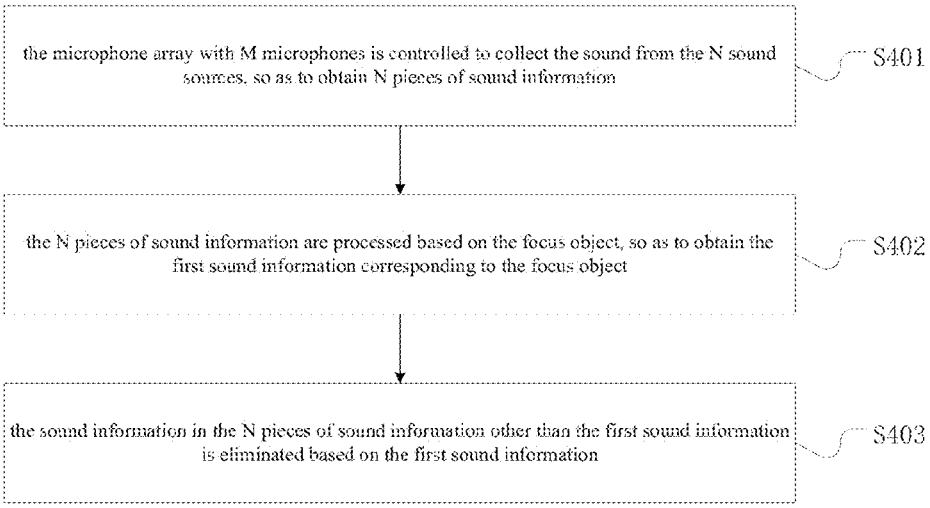
FIG. 4 is a flow chart of controlling an audio collection unit to collect sound from a sound source corresponding to a first direction according to the embodiment of the application.

In this case, as shown in FIG. 4, the specific implementation about how the audio collection unit is controlled to collect the sound from the sound source corresponding to the first direction specifically includes the steps of:

S401, the microphone array with M microphones is controlled to collect sound from N sound sources, so as to obtain N pieces of sound information.

S402, the N pieces of sound information are processed based on the focus object, so as to obtain the first sound information corresponding to the focus object.

S403, the sound information in the N pieces of sound information other than the first sound information is eliminated based on the first sound information.

First, in S401, the microphone array with M microphones is controlled to collect sound from the N sound sources, so as to obtain N pieces of sound information. In the embodiments of the application, though subject B being recorded is determined to be the focus object, when the microphone array is controlled to collect sound of subject B being recorded, sound from subject C is also collected since subject C is too close to subject B, which further results in obtaining sound information of two sound sources of subject B and C.

After these two pieces of sound information have been obtained, S402 will be executed: the N pieces of sound information are processed based on the focus object, so as to obtain the first sound information corresponding to the focus object.

In the embodiments of the application, since subject B is the focus object, it only needs sound from subject B. In this case, the collected two pieces of sound information will be processed based on the focus object, so as to determine the first sound information corresponding to the focus object.

More specifically, the specific process of determining the first sound information corresponding to the focus object is:

Step One: synthesizing M pieces of sub-sound information contained in each of the N pieces of sound information, so as to obtain N sound results corresponding to the N pieces of sound information.

Step Two: matching a first parameter contained in the N sound results with a second parameter corresponding to the focus object, so as to determine the first sound information corresponding to the focus object.

In the Step One, since M microphones were used to collect sound from B and C, each of the collected sound information contains M pieces of sub-sound information. When the M pieces of sub-sound information have been synthesized, it obtains sound results corresponding to the sound information of B and C.

Synthesized sound results are derived from calculating parameters such as volume of the sound information, pitches of the sound, and etc. While calculating, the volume of the sound information is related to the distance between the sound source and the image acquisition unit. Furthermore, in the Step Two, match is performed by using the corresponding first parameter in the two sound results and the parameter (such as a distance parameter) corresponding to the focus object. The sound information corresponding to the focus object is determined from these two sound results.

Then, sound information in the N pieces of sound information other than the first sound information will be eliminated, so that only the sound information corresponding to the focus object is reserved.

Implementation III:

There are N sound sources corresponding to the first direction, and N is an integer greater than or equal to 2.

In this case, it is similar to the case described in FIG. 3, in which the sound source corresponding to the first direction includes two sound sources, B and C.

Determining the focus object when the image acquisition unit is acquiring images specifically is:

When the image acquisition unit is acquiring images, P sound sources are determined from N sound sources as the focus objects, wherein $2 \leq P \leq N$.

In this case, at least two sound sources can be determined as the focus objects. Specifically, two subjects B and C are determined together as the focus objects.

Further, after two subjects B and C have been determined together as the focus objects, the audio collection unit is controlled to collected sound from the sound source corresponding to the first direction. Specifically, the microphone array with M microphones is controlled to collect sound from the P sound sources, so as to obtain P pieces of sound information.

In this case, since two subjects B and C have been determined together as the focus objects, sound from these two subjects will be collected simultaneously.

Hereafter, a specific scenario example will be used to describe the above-described cases in details.

For example, while holding a wedding ceremony, it is necessary to record the wedding with video camera.

In this case, the video camera has two or more microphones, and each of them has a microphone array.

The video camera is facing a stage, which has already been built. There's only one person, i.e., an emcee, on the stage is giving speech.

At this time, it will be the first implementation.

When photographing, the emcee is determined as the focus object. Then, information of the position relationship between the emcee and the video camera is obtained. Further, after the position relationship has been determined, the first direction information formed of the emcee and the camera is obtained. At last, the video camera controls all the microphone arrays on the video camera to face the direction of the emcee and collects sound from the emcee, so that the sound information corresponding to the recording images is obtained.

With the wedding continuing, the emcee will introduce groom and bride. At this time, there are 5 persons on the stage, which are the emcee, the groom, the bride, a groomsman, and a bridesmaid. And the groom and the bride are close to each other.

At this time, it will be the second implementation.

There are at least 5 sound sources in the direction to which the video camera is facing.

In this case, when the video camera determines the focus objects, one or more persons among these 5 persons will be determined as the focus objects.

In the case of determining one person, for example the groom, as the focus object, the first direction formed by the groom and the video camera will be obtained according series of processes.

Further, the sound from the sound source corresponding to the first direction will be collected.

At this time, if the groom and the bride are speaking at the same time, the sound of both of them will be collected, since they are very close to each other.

In this case, in order to determine the sound information corresponding to the focus objects, these two pieces of sound information will be filtered.

Specifically, each of the sound information will be calculated. Since the video camera uses M microphones to collect sound while collecting sound, the sound information from each sound source contains M pieces of sub-sound information.

Therefore, during calculation, synthesis will be conducted with the M pieces of sub-sound information, so as to obtain corresponding sound results.

When sound from the same sound source is being collected, since the M microphones are set at different positions of the video camera, pieces of sub-sound information collected by these microphones are different, and reflect sound information at different position of the same sound source respectively. Thus, while calculating, it is possible to obtain accurate results.

After two different sound results have been obtained, these two different sound results will be filtered according to related parameters of the groom, such as the relative distance to the video camera, relative direction, and etc. The filtered sound result is more matched, and is used as the sound information of the groom.

Furthermore, after the sound results have been filtered as needed, other unnecessary sound results will be eliminated, which are the sound results of the bride.

Thus, it is possible to prevent unnecessary noises from being collected, so that the sound results corresponding to the focus object will be collected to obtain more accurate sound effect.

Of course, the focus objects may be two or more persons. In this case, the focus object is an area, in which there are two or more persons. For example, the focus objects are the groom and the bride.

In this case, during sound collection, sound from these two persons will be collected.

For example, when the groom and the bride are appreciating the guests for attending at the same time, the sound from both of them will be collected simultaneously.

In the above embodiment, it describes implementations of the sound collection method. Hereafter, a corresponding electronic device will be described.

Embodiment II

In practical application, the electronic device has many forms, such as PADs, laptop computers, desktop computers, AllInOne PCs, mobile phones, video cameras, and etc. The method of the embodiments can be applied to enumerated computers.

Furthermore, the electronic device includes an image acquisition unit. However, in practical application, the image acquisition unit is actually a photographing device, which is capable of recording ongoing events, such as a wedding ceremony, or a meeting being held in an office. All these events can be actually filmed to record actual situations when the wedding ceremony or the meeting is being held.

Furthermore, in addition to the image acquisition unit capable of recording ongoing events, the electronic device further includes an audio collection unit, which is capable of collecting sound of the scene being recorded in real-time.

More specifically, the audio collection unit is a collecting unit including a microphone array with M microphones, M being greater than or equal to 2.

Figure 5:
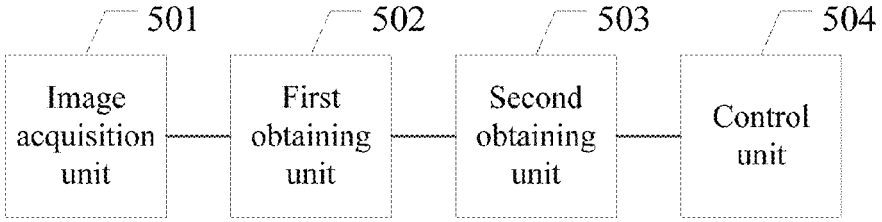
FIG. 5 is an illustrative diagram showing an electronic device according to the embodiment of the application.

Hereafter, with reference to FIG. 5, the electronic device includes: an image acquisition unit 501, a first obtaining unit 502, a second obtaining unit 503, and a control unit 504.

Hereafter, functions of respective unit will be described in details.

The image acquisition unit 501 is used to determine the focus object while acquiring images.

The first obtaining unit 502 is used to determine the position relationship information between the focus object and the image acquisition unit 501 based on the focus object.

The second obtaining unit 503 is used to obtain the first direction information based on the position relationship information.

The control unit 504 is used to control the audio collection unit to collect sound from the sound source corresponding to the first direction based on the first direction information.

Further, when there are N sound sources corresponding to the first direction and N is an integer greater than or equal to 2, the image acquisition unit 501 is used to determine a first sound source from the N sound sources as the focus object, while acquiring images.

Further, the control unit 504 specifically includes:

a collecting unit, for controlling the microphone array with M microphones to collect sound from N sound sources, so as to obtain N pieces of sound information.

a processing unit, for processing the N pieces of sound information based on the focus object, so as to obtain the first sound information corresponding to the focus object.

an eliminating unit, for eliminating the sound information in the N pieces of sound information other than the first sound information, based on the first sound information.

Further, the processing unit specifically includes:

a calculating unit, for synthesizing M pieces of sub-sound information contained in each of the N pieces of sound information, so as to obtain N sound results corresponding to the N pieces of sound information.

a matching unit, for matching a first parameter contained in the N sound results with a second parameter corresponding to the focus object, so as to obtain the first sound information corresponding to the focus object.

Further, when there are N sound sources corresponding to the first direction and N is an integer greater than or equal to 2, the image acquisition unit 501 is used to determine P sound sources from the N sound sources as the focus objects, while acquiring images, wherein $2 \leq P \leq N$.

Further, the control unit 504 is used to control the microphone array with M microphones to collect the sound from the P sound sources, so as to obtain P pieces of sound information.

The following technical effects may be achieved with one or more embodiments of the invention:

In one or more embodiments of the invention, a focus object is determined when the image acquisition unit is acquiring images; then a position relationship information between the focus object and the image acquisition unit is obtained based on the focus object; and a first direction information is obtained based on the position relationship information; at last, the audio collection unit is controlled to collect sound from a sound source corresponding to the first direction based on the first direction information. Thereby, when the image acquisition unit is acquiring the focus object, it is possible to collect the sound information corresponding to the focus object as appropriate and only the sound information corresponding to the focus object is collected, so that the technical problem of collected sound not matching the sound source from which the sound comes can be avoided, so as to make the collected sound corresponding to the sound source from which the sound comes.

Furthermore, the focus object can be one or more subjects, and the processing method for one subject and the processing method for more subjects are different. When there is only one focus object, the audio collection unit only collects sound from the sound source corresponding to the first direction and eliminates sound from other sound sources. However, when there are more focus objects, the audio collection unit collects sound from multiple sound sources simultaneously.

Those skilled in the art should understand that the embodiments of the invention can be provided as methods, systems, or computer program products. Thus, the invention may adopt forms of hardware, software, or a combination thereof. And, the invention may adopt a form of computer program products implemented on one or more computer-readable storage mediums (including but not limited to magnetic disk, CD-ROM, optical disk, and etc.), which contain computer-readable program codes.

The invention is described with reference to flow charts and/or block diagrams of methods, devices (systems), and computer program products according to the embodiments of the invention. It should be understood that it is possible to realize each flow and/or block of the flow charts and/or block diagrams, and the combination of flows and/or blocks of the flow charts and/or block diagrams with computer program instructions. It is possible to provide these computer program instructions to processors of general computers, dedicated computers, embedded computers, or other programmable data processing devices to generate a machine, so that instructions executed by computers or other programmable data processing devices generate a device to realize functions specified in one or more flows in the flow chats and/or one or more blocks in the block diagrams.

These computer program instructions may also be stored in a computer-readable memory, which can guide the computers or other programmable data processing devices to work in a specific way, so that instructions stored in the computer-readable memory generates products including instruction devices. The instruction devices realize functions specified in one or more flows in the flow chats and/or one or more blocks in the block diagrams.

These computer program instructions may also be loaded to the computers or other programmable data processing devices, in order to execute series of operations on the computers or other programmable data processing devices to generate processes realized by computers, so that instructions executed on the computers or other programmable data processing devices provides steps to realize functions specified in one or more flows in the flow chats and/or one or more blocks in the block diagrams.

Those skilled in the art may make various modifications and variations to the invention without departing from the spirit and scope of the invention. Thus, these modifications and variations of the invention fall within the scope of the claims of the invention and equivalent thereof, and the invention intends to include these modifications and variations.

The invention claimed is:

1. A sound collection method, the method being applicable to an electronic device that includes an image acquisition unit and an audio collection unit, the method comprising:

determining a focus object when the image acquisition unit is acquiring images;

obtaining a position relationship information between the focus object and the image acquisition unit based on the focus object;

obtaining a first direction information based on the position relationship information; and, controlling the audio collection unit to collect sound from a sound source corresponding to the first direction based on the first direction information, wherein, when there are N sound sources corresponding to the first direction and N is an integer greater than or equal to 2, the determining the focus object when the image acquisition unit are acquiring images comprises determining P sound sources from the N sound sources as the focus objects at the same time, when the image acquisition unit are acquiring images, wherein $2 \leq P \leq N$.

2. The method of claim 1, wherein the audio collection unit is a collecting unit that includes a microphone array with M microphones, and M is an integer greater than or equal to 2.

3. The method of claim 2, wherein, when the sound source corresponding to the first direction is the only sound source, the controlling the audio collection unit to collect sound from a sound source corresponding to the first direction comprises controlling the microphone array with M microphones to collect sound from the only sound source.

4. The method of claim 2, wherein, when there are N sound sources corresponding to the first direction and N is an integer greater than or equal to 2, the determining the focus object when the image acquisition unit are acquiring images comprises determining a first sound source from N sound sources as the focus object when the image acquisition unit are acquiring images.

5. The method of claim 4, wherein, the controlling the audio collection unit to collect sound from the sound source corresponding to the first direction comprises:

controlling the microphone array with M microphones to collect sound from N sound sources, so as to obtain N pieces of sound information;

processing the N pieces of sound information based on the focus object, so as to obtain the first sound information corresponding to the focus object; and, eliminating the sound information in the N pieces of sound information other than the first sound information, based on the first sound information.

6. The method of claim 5, wherein, the processing the N pieces of sound information based on the focus object so as to obtain the first sound information corresponding to the focus object comprises:

synthesizing M pieces of sub-sound information contained in each of the N pieces of sound information, so as to obtain N sound results corresponding to the N pieces of sound information; and, matching a first parameter contained in the N sound results with a second parameter corresponding to the focus object, so as to obtain the first sound information corresponding to the focus object.

7. The method of claim 1, wherein, the controlling the audio collection unit to collect sound from the sound source corresponding to the first direction comprises controlling the microphone array with M microphones to collect sound from P sound sources, so as to obtain P pieces of sound information.

8. An electronic device comprising:

an image acquisition unit for determining a focus object when the image acquisition unit is acquiring images;

a first obtaining unit, for obtaining a position relationship information between the focus object and the image acquisition unit based on the focus object;

a second obtaining unit, for obtaining a first direction information based on the position relationship information;

a control unit, for controlling an audio collection unit to collect the sound from a sound source corresponding to the first direction based on the first direction information, wherein, when there are N sound sources corresponding to the first direction and N is an integer greater than or equal to 2, the image acquisition unit is used to, when the image acquisition unit are acquiring images, determine P sound sources from the N sound sources as the focus objects at the same time wherein $2 \leq P \leq N$.

9. The electronic device of claim 8, wherein, the audio collection unit is a collecting unit which includes a microphone array with M microphones, and M is an integer greater than or equal to 2.

10. The electronic device of claim 9, wherein, when there are N sound sources corresponding to the first direction and N is an integer greater than or equal to 2, the image acquisition unit determines, when the image acquisition unit are acquiring images, a first sound source from the N sound sources as the focus object.

11. The electronic device of claim 10, wherein the control unit comprises:

a collecting unit, for controlling the microphone array with M microphones to collect sound from N sound sources, so as to obtain N pieces of sound information;

a processing unit, for processing N pieces of sound information based on the focus object, so as to obtain the first sound information corresponding to the focus object; and an eliminating unit, for eliminating the sound information in the N pieces of sound information other than the first sound information.

12. The electronic device of claim 11, wherein, the processing unit comprises:

a calculating unit, for synthesizing M pieces of sub-sound information contained in each of the N pieces of sound information, so as to obtain N sound results corresponding to the N pieces of sound information; and a matching unit, for matching a first parameter contained in the N sound results with a second parameter corresponding to the focus object, so as to obtain the first sound information corresponding to the focus object.

13. The electronic device of claim 8, wherein, the control unit is used to control the microphone array with M microphones to collect sound from P sound source, so as to obtain P pieces of sound information.

* * * * *